US011303077B2

(12) United States Patent
Mao et al.

(10) Patent No.: US 11,303,077 B2
(45) **Date of Patent: *Apr. 12, 2022**

(54) ELECTRICAL CONNECTOR WITH ISOLATION PLATE

(71) Applicant: Drapho Electronics Technology., Ltd, Kunshan (CN)

(72) Inventors: Yuhua Mao, Kunshan (CN); Hongjiang Yao, Kunshan (CN); Zhihong Fang, Kunshan (CN)

(73) Assignee: Drapho Electronics Technology., Ltd, Kunshan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/930,997

(22) Filed: Jul. 16, 2020

(65) Prior Publication Data

US 2021/0135411 A1 May 6, 2021

(30) Foreign Application Priority Data

Oct. 31, 2019 (CN) ..... 201911056045.X

(51) Int. Cl.

| | |
|---|---|
| ***H01R 24/00*** | (2011.01) |
| ***H01R 24/60*** | (2011.01) |
| ***H01R 13/24*** | (2006.01) |
| ***H01R 13/6461*** | (2011.01) |
| ***H01R 13/652*** | (2006.01) |

(52) U.S. Cl.

CPC ..... *H01R 24/60* (2013.01); *H01R 13/24* (2013.01); *H01R 13/6461* (2013.01); *H01R 13/652* (2013.01)

(58) Field of Classification Search

CPC ..... H01R 24/60; H01R 24/62; H01R 13/24; H01R 13/40; H01R 13/64; H01R 13/652; H01R 12/55; H01R 12/57

USPC ..... 439/676

See application file for complete search history.

(56) References Cited

U.S. PATENT DOCUMENTS

| | | | | |
|---|---|---|---|---|
| 10,236,638 | B2 * | 3/2019 | Kong | H01R 13/6582 |
| 2016/0359256 | A1 * | 12/2016 | Zhang | H01R 13/405 |
| 2017/0133797 | A1 * | 5/2017 | Guo | H01R 24/62 |
| 2017/0294753 | A1 * | 10/2017 | Wu | H01R 13/405 |

(Continued)

FOREIGN PATENT DOCUMENTS

| | | | |
|---|---|---|---|
| CN | 106998014 | A | 8/2017 |
| CN | 209844104 | U | 12/2019 |
| CN | 110854625 | A | 2/2020 |

*Primary Examiner* — Khiem M Nguyen

(74) *Attorney, Agent, or Firm* — Andrus Intellectual Property Law, LLP

(57) ABSTRACT

Provided is an electrical connector. The electrical connector includes an insulation body, a terminal group and an isolation plate, where the terminal group and the isolation plate are received in the insulation body. The terminal group includes upper-row terminals and lower-row terminals. The isolation plate is between the upper-row terminals and the lower-row terminals. The isolation plate has a pair of upper grounding arms and a pair of lower grounding arms which are integrally connected with the isolation plate. The pair of upper grounding arms is in a same plane as the upper-row terminals and is on two sides of the upper-row terminals respectively. The pair of lower grounding arms is in a same plane as the lower-row terminals and is on two sides of the lower-row terminals respectively.

9 Claims, 7 Drawing Sheets

(56) References Cited

U.S. PATENT DOCUMENTS

| | | | | |
|---|---|---|---|---|
| 2019/0348785 | A1* | 11/2019 | Tsai | H01R 13/08 |
| 2021/0013689 | A1* | 1/2021 | Sakoda | H01R 43/24 |
| 2021/0066874 | A1* | 3/2021 | Sakaizawa | H01R 13/6586 |
| 2021/0135411 | A1* | 5/2021 | Mao | H01R 13/24 |

* cited by examiner

ELECTRICAL CONNECTOR WITH ISOLATION PLATE

CROSS-REFERENCES TO RELATED APPLICATIONS

This application claims priority to a Chinese patent application No. CN201911056045.X filed on Oct. 31, 2019, the entire contents of which are incorporated herein by reference.

TECHNICAL FIELD

This application relates to the field of electrical connectors.

BACKGROUND

With the development trend of miniaturization and thinness of consumer electronic products such as notebooks, tablets, and mobile phones, designs and manufacturing processes of their parts and components are becoming more and more demanding. As the product becomes thinner and thinner, its internal space has become very small, which requires a dense internal layout, smaller volume of each electronic component, and smaller thickness of the product. For some connectors that transmit high-frequency signals, the thin and small volume makes the arrangement of terminals within the connector denser and compacter, which inevitably has a cetin impact on the signal transmission. In order to shield the signal interference between the terminals, some connectors are provided with additional shield elements. For example, a USB connector has a metal isolation plate embedded between upper-row terminals and lower-row terminals, and the interference between the upper-row signals and lower-row signals is isolated by the metal isolation plate. However, as the requirement for signal quality becomes higher and higher, the existing metal isolation plate can only provide isolation between the upper-row signals and lower-row signals, but cannot provide more isolation shielding effects, so it is difficult to meet the increasing requirements for electrical performance of products.

SUMMARY

A technical problem solved by the present disclosure is to provide an electrical connector to improve a problem of insufficient shielding function of the isolation plate in the related art.

To solve the above problem, the present disclosure adopts the following technical solutions. An electrical connector includes an insulation body, a terminal group and an isolation plate, where the terminal group and the isolation plate are received in the insulation body. The terminal group includes upper-row terminals and lower-row terminals. The isolation plate is between the upper-row terminals and the lower-row terminals. The isolation plate is provided with a pair of upper grounding arms and a pair of lower grounding arms, and the pair of upper grounding arms and the pair of lower grounding arms are integrally connected with the isolation plate. The pair of upper grounding arms is in a same plane as the upper-row terminals and is on two sides of the upper-row terminals respectively, and the pair of lower grounding arms is in a same plane as the lower-row terminals and is on two sides of the lower-row terminals respectively.

In one or more embodiments, the isolation plate includes a base plate, which has a front surface facing the upper-row terminals and a back surface facing the lower-row terminals. Each of the pair of upper grounding arms is in an elongated shape, protrudes upwardly from the front surface and extends from rear to front, and two ends of each of the pair of upper grounding arms are integrally connected with the base plate.

In one or more embodiments, the base plate is provided with grooves directly below the pair of upper grounding arms. The pair of upper grounding arms and the pair of lower grounding arms are in one-to-one correspondence in a vertical direction, and the groove is between the upper grounding arm and the lower grounding arm.

In one or more embodiments, the pair of upper grounding arms is formed on two sides of the front surface of the base plate in a tearing forming manner.

In one or more embodiments, the pair of lower grounding arms is below the base plate and extends in an elongated shape from rear to front. Each of the pair of lower grounding arms has a rear end and a front end, the rear end is integrally connected with the base plate via a U-shaped bending arm, and the front end that is a free end.

In one or more embodiments, a projection of the upper grounding arm in the vertical direction at least partially overlaps with a projection of the lower grounding arm in the vertical direction.

In one or more embodiments, the insulation body is provided with a docking tongue plate having a top surface and a bottom surface, the upper-row terminals and the pair of upper grounding arms are disposed on the top surface, and the lower-row terminals and the pair of lower grounding arms are disposed on the bottom surface.

In one or more embodiments, the isolation plate is further provided with a first mounting leg, a second mounting leg and third mounting legs. The first mounting leg, the second mounting leg and the third mounting legs extend from a rear end of the base plate. The first mounting leg and the second mounting leg extend from a rear edge of the base plate and are distributed in a front-rear direction, and the third mounting legs extend outwardly from two side edges of the base plate respectively.

In one or more embodiments, a front edge of the base plate is provided with a notch recessed backwardly, the base plate is further provided with an elongate hole vertically running through the base plate, and the front surface and the back surface are communicated by the elongate hole.

Compared with the related art, the structure of the isolation plate of the present disclosure is improved, such that the isolation plate not only provides an insolation function, but also serves as a grounding element since the isolation plate includes the upper grounding arms and lower grounding arms extending into the terminal array, thereby better ensuring the signal transmission quality of the upper-row terminals and the lower-row terminals.

DETAILED DESCRIPTION

Please referring to FIG. 1 through FIG. 7, an electrical connector is provided in the present disclosure. The electrical connector includes an insulation body 10, a terminal group 20 and an isolation plate 30 received in the insulation body 10, and a housing 40 coating a surface of the insulation body 10. The terminal group 20 and the isolation plate 30 are fixed inside the insulation body 10 and are used for realizing a stable signal transmission. The housing 40 is used for shielding external interference signals and also provides a protection function for the insulation body 10. A specific structure and function of each part are described below in details.

Figure 1:
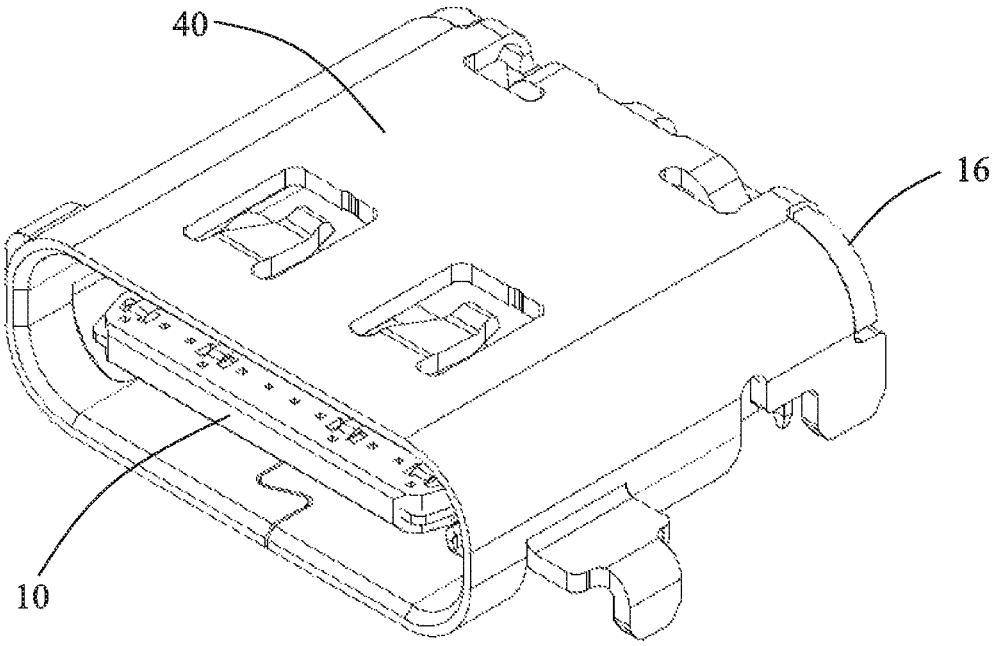
FIG. 1 is a perspective view of an electrical connector according to the present disclosure.
Figure 2:
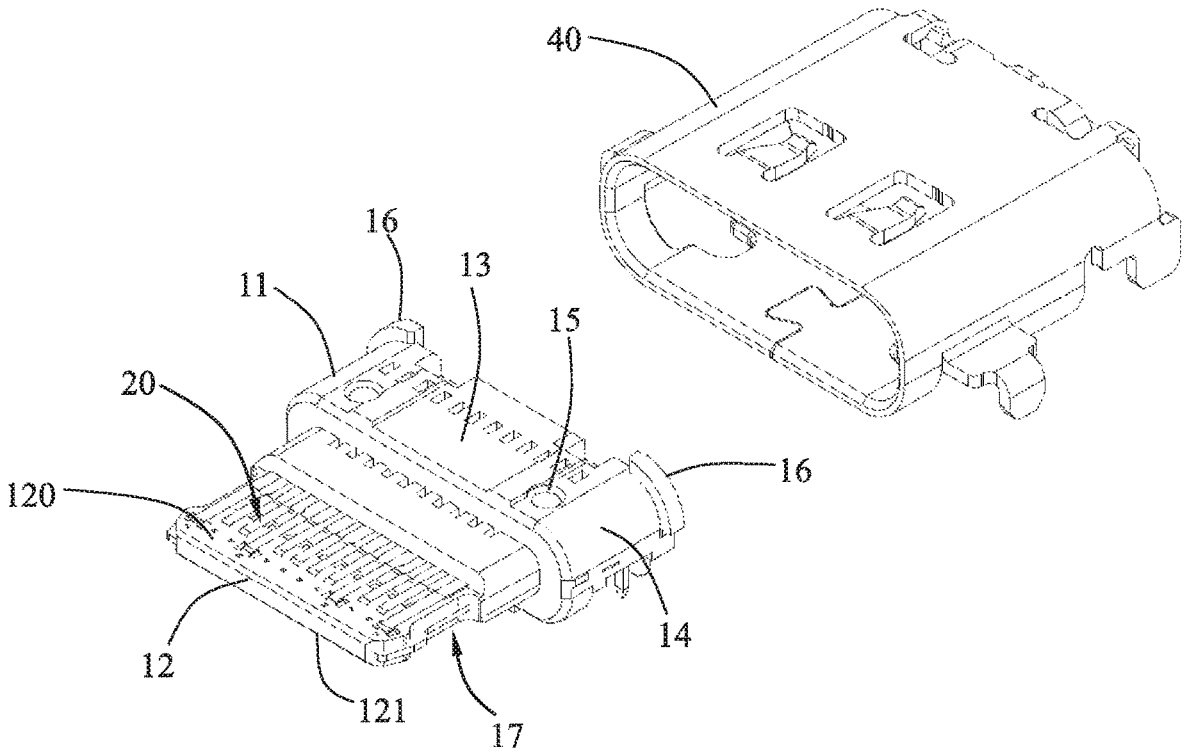
FIG. 2 is an exploded view of a part of the electrical connector according to the present disclosure.
Figure 3:
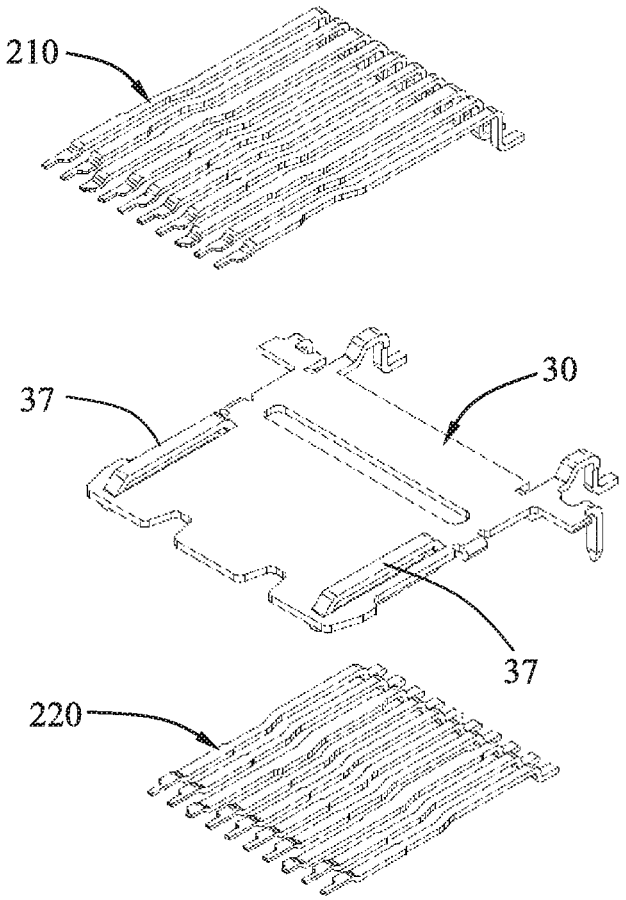
FIG. 3 is a schematic view of upper-row terminals and lower-row terminals of the electrical connector according to the present disclosure.

As shown in FIG. 1 and FIG. 2, the insulation body 10 includes a base part 11 and a docking tongue plate 12 that extends forwardly from the base part 11. Two sides of the base part 11 are provided with a top surface 13 and a pair of arcuate wall surfaces 14 located at two sides of the top surface 13 respectively. The top surface 13 includes grooves 15 for positioning with the housing 40 in an engaged manner. The pair of arcuate wall surfaces 14 is used for assembling with the housing 40 in an attached manner. In addition, a stopper 16 protruding upwardly is provided on a rear side of the top surface 13. The stopper 16 abuts against the housing 40 from the rear to realize a front-rear direction limitation. The docking tongue plate 12 has a top surface 120 and a bottom surface 121, and is configured to support the terminal group 20. Furthermore, recessed parts 17 recessed inwardly are provided at two sides of the docking tongue plate 12 respectively.

Figure 6:
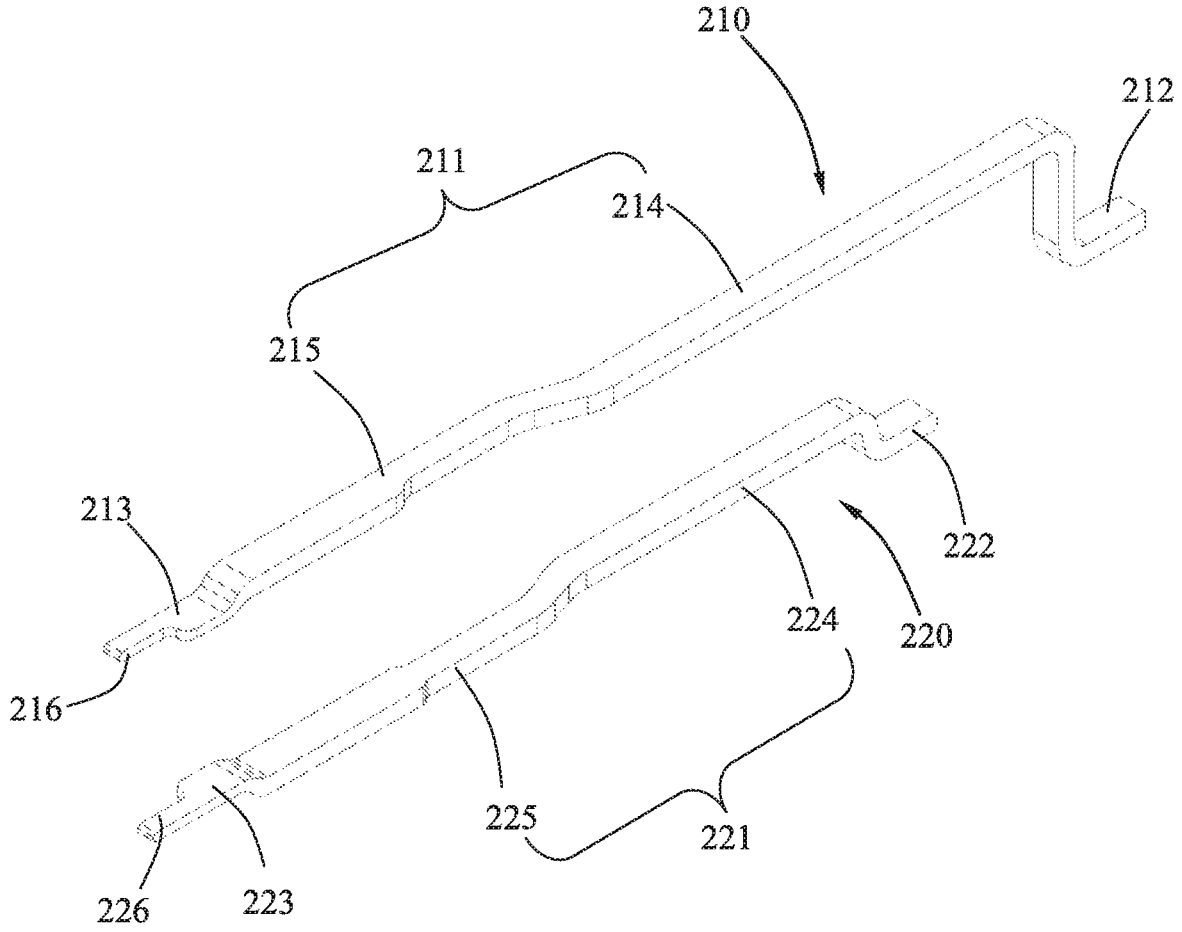
FIG. 6 is a schematic view of a signal upper-row terminal and a single lower-row terminal of the electrical connector according to the present disclosure.

As shown in FIG. 2 and FIG. 6, the terminal group 20 includes upper-row terminals 210 and lower-row terminals 220. A number of the upper-row terminals 210 is equal to a number of the lower-row terminals 220. The upper-row terminals 210 and the lower-row terminals 220 are arranged in one-to-one correspondence in a vertical direction. The upper-row terminals 210 are disposed on the top surface 120 of the docking tongue plate 12, and the lower-row terminals 220 are disposed on the bottom surface 121 of the docking tongue plate 12. Each of the upper-row terminals 210 is provided with an upper contacting arm 211 exposed to the top surface 120 of the docking tongue plate 12 and an L-shaped upper mounting arm 212 extending from a rear end of the upper contacting arm 211. The upper contacting arm 211 extends from rear to front, and an upper embedded part 213 is provided at a front end of the upper contacting arm 211. The upper embedded part 213 is configured to be embedded in the docking tongue plate 12. Each of the lower-row terminals 220 is provided with a lower contacting arm 221 exposed to the bottom surface 121 of the docking tongue plate 12 and a lower mounting arm 222 extending from a rear end of the lower contacting arm 221. The lower contacting arm 221 extends from rear to front, and a lower embedded part 223 is provided at a front end of the lower contacting arm 221.

It is noted that in one or more embodiments of the present disclosure, the upper contacting arm 211 includes an upper main arm 214 and an upper offset arm 215 extending forwardly from a front end of the upper main arm 214, the upper offset arm 215 and the upper main arm 214 are in an integral structure, but the upper offset arm 215 is arranged offset with respect to the upper main arm 214 in a horizontal plane; the lower contacting arm 221 includes a lower main arm 224 and a lower offset arm 225 extending forwardly from a front end of the lower main arm 224, the lower offset arm 225 and the lower main arm 224 are in an integral structure, and the lower offset arm 225 is arranged offset with respect to the lower main arm 224 in the horizontal plane. It should be noted that the upper main arm 214 is secured at an upper side of the docking tongue plate 12, the lower main arm 224 is secured at a lower side of the docking tongue plate 12, and the upper main arm 214 and the lower main arm 224 are arranged in a stagger manner in the vertical direction, such that a projection of the upper main arm 214 and a projection of the lower main arm 224 do not overlap. The upper offset arm 215 is arranged offset in a first direction from the front end of the upper main arm 214, and the lower offset arm 225 is arranged offset in a second direction from the front end of the lower main arm 224 where the second direction is opposite to the first direction, such that in the vertical direction, a projection of the upper offset arm 215 and a projection of the lower offset arm 225 coincide. That is, the upper main arm 214 of the upper-row terminal 210 and the lower main arm 224 of the lower-row terminal 220 corresponding to the upper-row terminal 210 are arranged in a stagger manner in the vertical direction, and the projection of the upper main arm 214 and the projection of the lower main arm 224 do not overlap. The upper offset arm 215 of the upper-row terminal 210 extends forwardly from the front end of the upper main arm 214, the lower offset arm 225 of the lower-row terminal 220 extends forwardly from the front end of the lower main arm 224, and the upper offset arm 215 and the lower offset arm 225 are arranged close to each other in such a manner that in the vertical direction, the projection of the upper offset arm 215 and the projection of the lower offset arm 225 coincide.

Figure 7:
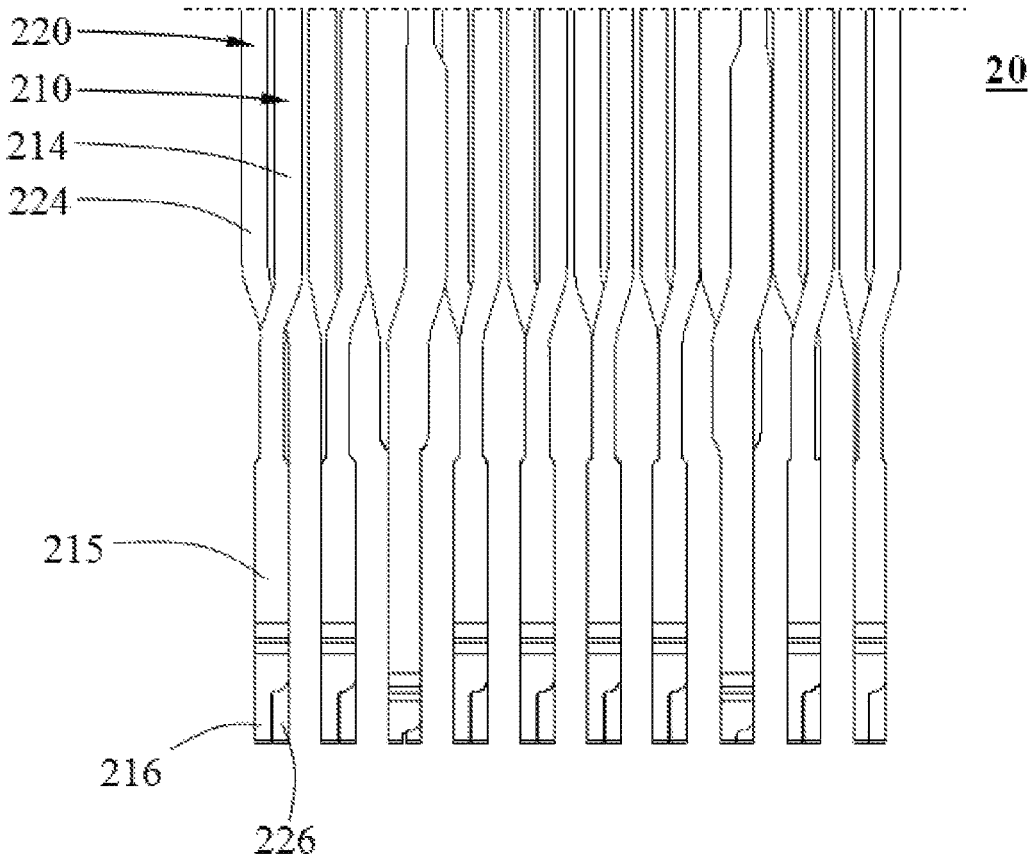
FIG. 7 is a schematic view illustrating an arrangement of upper-row terminals and lower-row terminals in an assembled state according to the present disclosure.

In addition, the upper embedded part 213 is bent downwardly from the front end of the upper contacting arm 211 and is embedded in the docking tongue plate 12, the lower embedded part 223 is bent upwardly from the front end of the lower contacting arm 221 and is embedded in the docking tongue plate 12, such that the terminals are fastened. It should be noted that in one or more embodiments of the present disclosure, the upper embedded part 213 is provided with an upper limit arm 216 slanted leftward, the lower embedded part 223 is provided with a lower limit arm 226 slanted rightward, such that as shown in FIG. 7, the upper limit arms 216 of the upper-row terminals 210 and the lower limit arms 226 of the lower-row terminals 220 are arranged in a stagger manner in the vertical direction.

For one upper-row terminal 210 and one lower-row terminal 220 corresponding the one upper-row terminal 210, some parts of the upper-row terminal 210 and some parts of the corresponding lower-row terminal 220 coincide in the vertical direction, while some parts of the upper-row terminal 210 and some parts of the corresponding lower-row terminal 220 are arranged in a stagger manner in the vertical direction. The upper offset arm 215 serves as the electrical contacting portion of the upper-row terminal 210 and the lower offset arm 225 serves as the electrical contacting portion of the lower-row terminal 220, and therefore, the overlapping of the upper offset arm 215 and the lower offset arm 225 in the vertical direction is more beneficial to the signal transmission. The upper mounting arm 212 serves as the mounting portion of the upper-row terminal 210, and the lower mounting arm 222 serves as the mounting portion of the lower-row terminal 220. The upper mounting arm 212 and the lower mounting arm 222 extend backwardly outside the insulation body 10 and are configured to be soldered to a circuit board (not shown), and therefore, the staggering of the upper mounting arm 212 and the lower mounting arm 222 in the vertical direction is more beneficial to the mounting operation.

Figure 4:
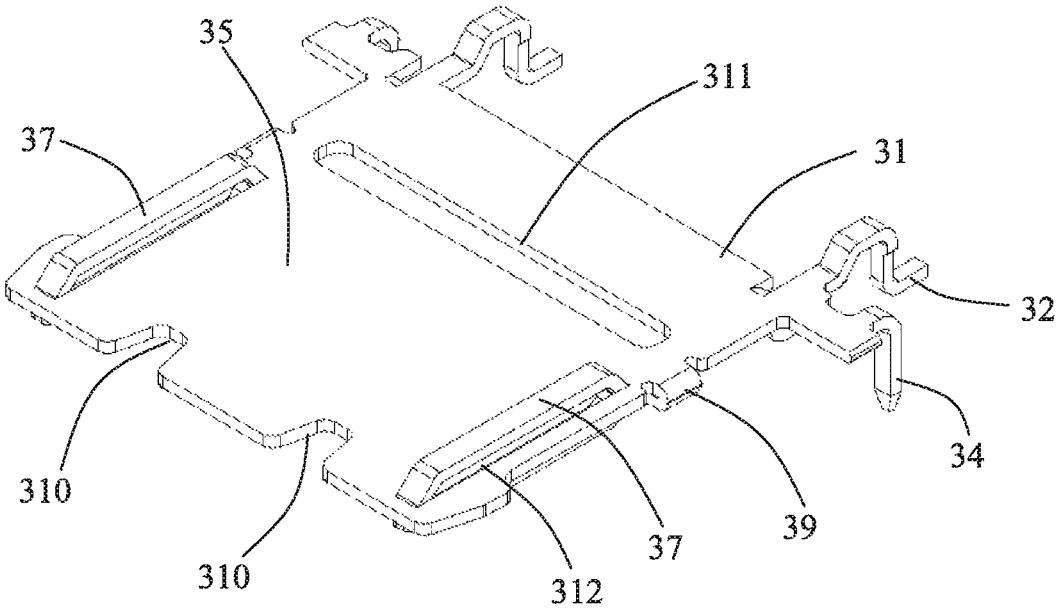
FIG. 4 is a perspective view of the electrical connector when a top surface of an insulation plate faces upwardly according to the present disclosure.
Figure 5:
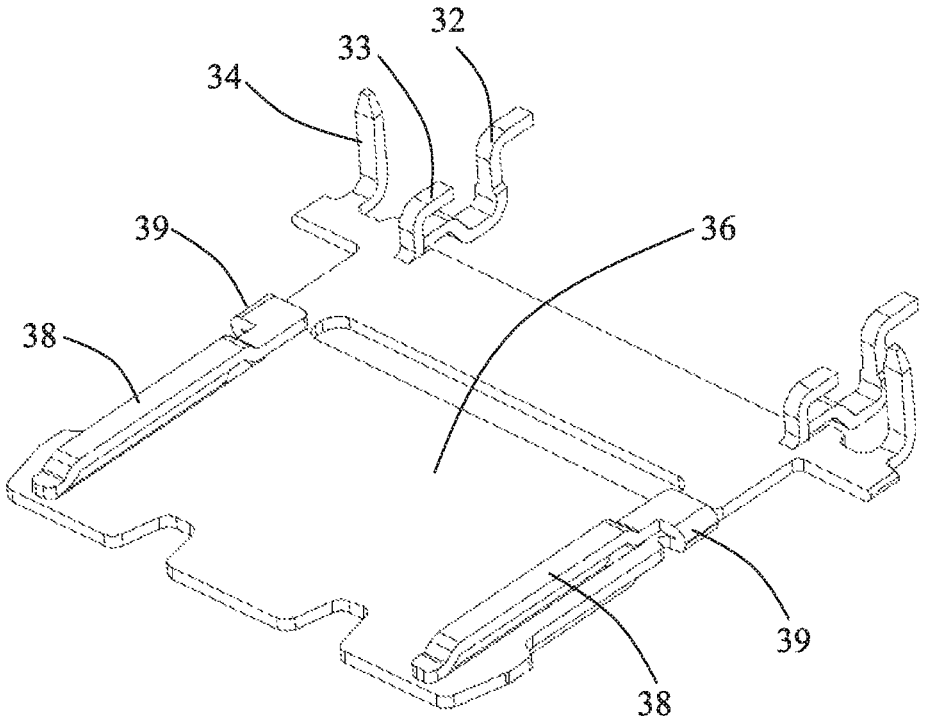
FIG. 5 is a perspective view of the electrical connector when a bottom surface of an insulation plate faces upwardly according to the present disclosure.

As shown in FIG. 4 and FIG. 5, the isolation plate 30 is embedded in the docking tongue plate 12 and is between the upper-row terminals 210 and the lower-row terminals 220, and the isolation plate 30 provides an isolation function. The isolation plate 30 is made of metal and is formed through integrally stamping and bending the metal material. The isolation plate 30 includes a base plate 31, a first mounting leg 32, a second mounting leg 33, and a third mounting leg 34, where the first mounting leg 32, the second mounting leg 33 and the third mounting leg 34 extend from a rear end of the base plate 31. The base plate 31 has a front surface 35 facing upwardly and a back surface 36 facing downwardly. The base plate 31 includes a pair of upper grounding arms 37 arranged on two sides of the front surface 35 respectively and a pair of lower grounding arms 38 bent downwardly from two side edges of the front surface 35 respectively. A pair of notches 310 recessed backwardly is provided at a front edge of the base plate 31. The base plate 31 is further provided with an elongated hole 311 which runs through the base plate 31 in the vertical direction, and the front surface 35 and the back surface 36 are communicated through the hole 311. Each of the pair of upper grounding arms 37 protrudes upwardly from front surface 35 and is in an elongated shape. The pair of upper grounding arms 37 extends from rear to front along two side edges of the base plate 31 respectively. The pair of lower grounding arms 38 is below the base plate 31. Each of the pair of lower grounding arms 38 is integrally connected with the base plate 31 via a U-shaped bending arm 39. The pair of lower grounding arms 38 is in an elongated shape and extends from rear to front. The first mounting legs 32 and the second mounting legs 33 extend from the rear edge of the base plate 31 and are distributed in a front-rear direction. The first mounting legs 32 are at two sides of the upper-row terminals 210 respectively, and the second mounting legs 33 are at two sides of the lower-row terminals 220 respectively. The third mounting legs 34 are at exterior sides of the first mounting legs 32 and the second mounting legs 33 respectively. The third mounting legs 34 are directly inserted into a circuit board to realize electrical connection. In the front-rear direction, the third mounting legs 34 are between the first mounting legs 32 and the second mounting legs 33.

It should be noted that the pair of upper grounding arms 37 and the pair of lower grounding arms 38 are on the front side and the back side of the base plate 31 respectively, and the projection of the pair of upper grounding arms 37 in the vertical direction and the projection of the pair of lower grounding arms 38 in the vertical direction at least partially overlap. Furthermore, the upper grounding arm 37 is formed on the base plate 31 in a tearing forming manner, so both a front end and a rear end of the upper grounding arm 37 are integrally connected with the base plate 31. The base plate 31 has a groove 312 formed by the tearing forming, and the groove 312 is directly below the upper grounding arm 37. The two upper grounding arms 37 extend parallel to each other. A front end of the lower grounding arm 38 is a free end. The front end of the lower grounding arm 38 is not integrally connected with the base plate 31, but is connected with the back surface 36 of the base plate 31 in a lap manner. A rear end of the lower grounding arm 38 is integrally connected with the U-shaped bending arm 39. The upper grounding arms 37 are at the front and end sides of the array of upper-row terminals 210, and are arranged to be parallel to the upper-row terminals 210. The lower grounding arms 38 are at the front and end sides of the array of lower-row terminals 220, and are arranged to be parallel to the lower-row terminals 220. In this way, the upper-row terminals 210 are isolated from the lower-row terminals 220 by the isolation plate 30. In addition, the isolation plate 30 is further provided with the upper grounding arms 37 exposed to the top surface 120 of the docking tongue plate 12 and the lower grounding arms 38 exposed to the bottom surface 121 of the docking tongue plate 12, so the isolation plate 30 serves as a grounding element of the upper-row terminals 210 and the lower-row terminals 220, which can effectively improve the signal transmission. Furthermore, the upper grounding arms 37, the lower grounding arms 38, and the base plate 38 are in an integral structure, thereby ensuring the stability of the grounding connection and satisfying requirements of high-frequency transmission.

In view of the above, the isolation plate of the present disclosure includes upper grounding arms and lower grounding arms which extend into the terminal array, such that the isolation plate serves as the grounding element, thereby better ensuring the signal transmission of the terminals.

The above description is only the exemplary embodiments of the present invention, and does not limit the present invention in any form. Any possible variations and modifications made by those skilled in the art by using the method and content disclosed above without departing from the scope of the technical solution of the present invention should be covered by the claims of the present invention.

What is claimed is:

1. An electrical connector, comprising:

an insulation body;

a terminal group; and an isolation plate, wherein the terminal group and the isolation plate are received in the insulation body, the terminal group comprises upper-row terminals and lower-row terminals, and the isolation plate is between the upper-row terminals and the lower-row terminals, wherein the isolation plate is provided with a pair of upper grounding arms and a pair of lower grounding arms, the pair of upper grounding arms and the pair of lower grounding arms are integrally connected with the isolation plate, the pair of upper grounding arms is in a same plane as the upper-row terminals and is on two sides of the upper-row terminals respectively, the pair of lower grounding arms is in a same plane as the lower-row terminals and is on two sides of the lower-row terminals respectively.

2. The electrical connector of claim 1, wherein the isolation plate comprises a base plate, the base plate has a front surface facing the upper-row terminals and a back surface facing the lower-row terminals, each of the pair of upper grounding arms is in an elongated shape, protrudes upwardly from the front surface and extends from rear to front, wherein two ends of each of the pair of upper grounding arms are integrally connected with the base plate.

3. The electrical connector of claim 2, wherein the base plate is provided with grooves directly below the pair of upper grounding arms, the pair of upper grounding arms and the pair of lower grounding arms are in one-to-one correspondence in a vertical direction, and the groove is between the upper grounding arm and the lower grounding arm.

4. The electrical connector of claim 3, wherein the pair of upper grounding arms is formed on two sides of the front surface of the base plate in a tearing forming manner.

5. The electrical connector of claim 4, wherein the pair of lower grounding arms is below the base plate and extends in an elongated shape from rear to front, wherein each of the pair of lower grounding arms has a rear end and a front end, the rear end is integrally connected with the base plate via a U-shaped bending arm, and the front end that is a free end.

6. The electrical connector of claim 5, wherein a projection of the upper grounding arm in the vertical direction at least partially overlaps with a projection of the lower grounding arm in the vertical direction.

7. The electrical connector of claim 6, wherein the insulation body is provided with a docking tongue plate, the docking tongue plate has a top surface and a bottom surface, the upper-row terminals and the pair of upper grounding arms are disposed on the top surface, and the lower-row terminals and the pair of lower grounding arms are disposed on the bottom surface.

8. The electrical connector of claim 7, wherein the isolation plate is further provided with a first mounting leg, a second mounting leg and third mounting legs, the first mounting leg, the second mounting leg and the third mounting legs extend from a rear end of the base plate, wherein the first mounting leg and the second mounting leg extend from a rear edge of the base plate and are distributed in a front-rear direction, and the third mounting legs extend outwardly from two side edges of the base plate respectively.

9. The electrical connector of claim 8, wherein a front edge of the base plate is provided with a notch recessed backwardly, the base plate is further provided with an elongate hole vertically running through the base plate, and the front surface and the back surface are communicated by the elongate hole.

* * * * *